US006321529B1

(12) United States Patent
Mueller et al.

(10) Patent No.: US 6,321,529 B1
(45) Date of Patent: Nov. 27, 2001

(54) OPERATING METHOD AND EXHAUST SYSTEM OF A MULTI-CYLINDER INTERNAL-COMBUSTION ENGINE

(75) Inventors: Peter Mueller; Stefan Detterbeck, both of Munich; Maximilian Engl, Friedberg; Stephan Ramatschi, Zorneding, all of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/417,313

(22) Filed: Oct. 13, 1999

(30) Foreign Application Priority Data

Nov. 12, 1998 (DE) ..... 198 52 294

(51) Int. Cl.[7] ..... F01N 3/00

(52) U.S. Cl. ..... 60/274; 60/276; 60/277; 60/285

(58) Field of Search ..... 60/274, 276, 277, 60/285, 299

(56) References Cited

U.S. PATENT DOCUMENTS

| | | | | |
|---|---|---|---|---|
| 5,207,057 | | 5/1993 | Kayanuma | 60/276 |
| 5,233,829 | | 8/1993 | Komatsu | 60/276 |
| 5,317,868 | | 6/1994 | Blischke et al. . | |
| 5,351,484 | | 10/1994 | Wade . | |
| 5,357,753 | | 10/1994 | Wade . | |
| 5,444,977 | | 8/1995 | Kawabata . | |
| 5,467,594 | * | 11/1995 | Aoki et al. | 60/276 |
| 5,544,481 | | 8/1996 | Davey et al. . | |
| 5,600,056 | | 2/1997 | Hasegawa et al. . | |
| 5,657,625 | * | 8/1997 | Koga et al. | 60/274 |
| 5,979,160 | * | 11/1999 | Yashiki et al. | 60/276 |
| 6,047,542 | * | 4/2000 | Kinugasa et al. | 60/274 |
| 6,047,544 | * | 4/2000 | Yamamoto et al. | 60/285 |

FOREIGN PATENT DOCUMENTS

| | | |
|---|---|---|
| 19503852A1 | 8/1995 | (DE) . |
| 19524980A1 | 1/1997 | (DE) . |
| 19629554A1 | 2/1998 | (DE) . |
| 19837074A1 | 3/1999 | (DE) . |
| 727 568 | 8/1996 | (EP) . |

OTHER PUBLICATIONS

German Office Action/Search Report, Jun. 25, 1999.
Bosch Manual, 22$^{nd}$ Edition, VDI Publishers, Duesseldorf, pp. 490–493.

* cited by examiner

*Primary Examiner*—Thomas Denion
*Assistant Examiner*—Binh Tran
(74) *Attorney, Agent, or Firm*—Crowell & Moring LLP

(57) ABSTRACT

An exhaust system of a multi-cylinder internal-combustion engine has at least one system part in which the internal-combustion engine exhaust gases or portions thereof are first guided through at least two partial pipe trains apportioned to cylinder groups, in which partial pipe trains, one starting catalyst respectively is inserted and which combine to form a joint main pipe in which a main catalyst is inserted, at least one lambda probe being arranged in front of and one lambda probe being arranged behind the catalysts. In front of each starting catalyst, a lambda probe is arranged and an additional lambda probe is arranged in at least one partial pipe train behind the starting catalyst.

14 Claims, 1 Drawing Sheet

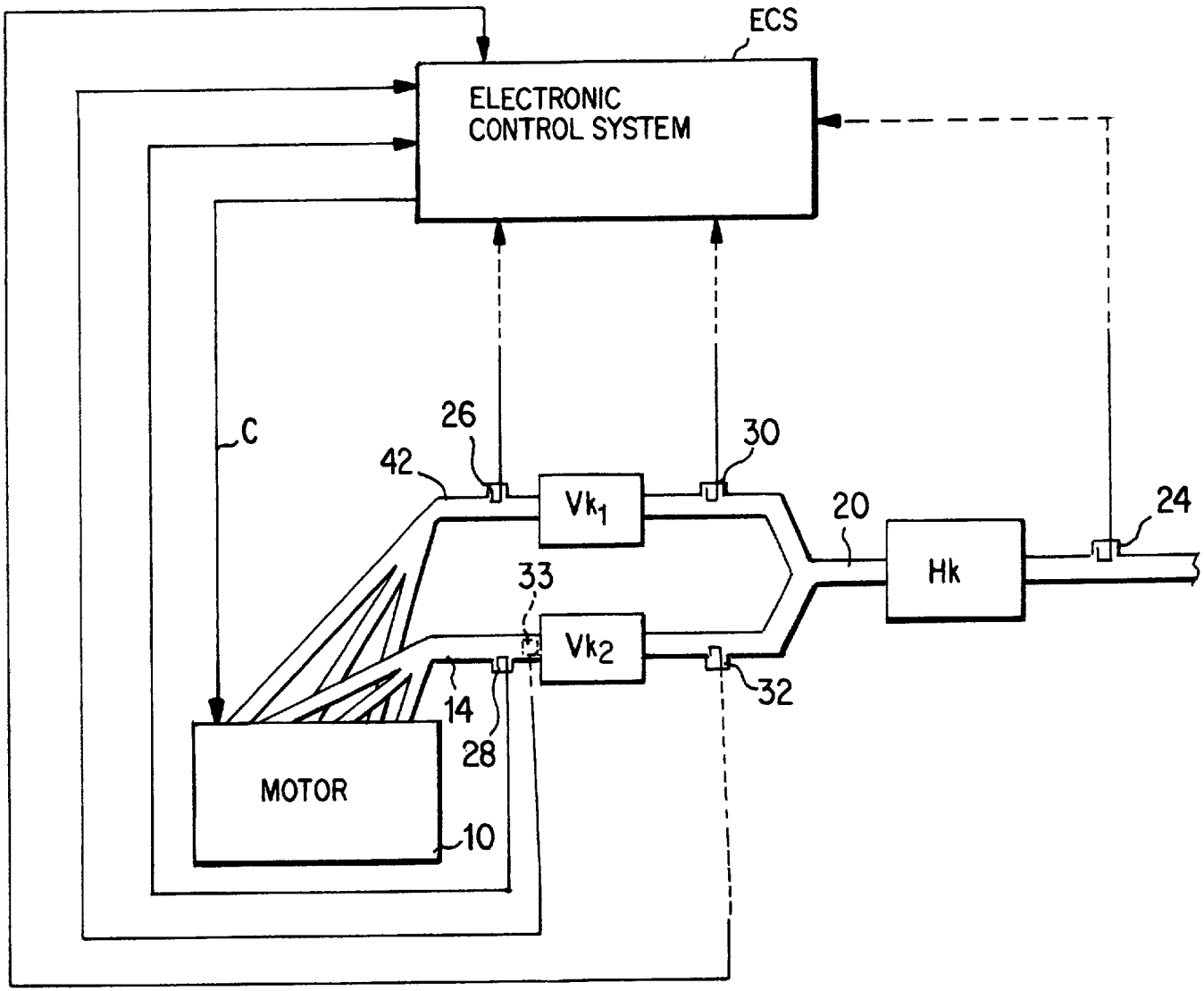
ECS
ELECTRONIC CONTROL SYSTEM
24
Hk
20
30
32
Vk1
Vk2
33
26
42
28
14
10
MOTOR
C

OPERATING METHOD AND EXHAUST SYSTEM OF A MULTI-CYLINDER INTERNAL-COMBUSTION ENGINE

BACKGROUND AND SUMMARY OF THE INVENTION

This application claims the priority of German application 198 52 294.0, filed Nov. 12, 1998, the disclosure of which is expressly incorporated by reference herein.

The invention relates to an exhaust system of a multi-cylinder internal-combustion engine having at least one system part in which the internal-combustion engine exhaust gases or portions thereof are first guided through at least two partial pipe trains apportioned to cylinder groups, in which partial pipe trains, one starting catalyst respectively is inserted and which combine to form a joint main pipe in which a main catalyst is inserted, at least one lambda probe being arranged in front of and one lambda probe being arranged behind the catalysts.

In the course of the tightening of the emission control laws, an optimal pollutant reduction of internal-combustion engines is becoming increasingly important. The aftertreatment of the exhaust gases in a catalyst is known. For an optimal operating method of a catalyst, a favorable exhaust gas composition must be ensured which takes place by a lambda control known per se. In the simplest case, a lambda probe is arranged in front of a catalyst and emits a signal to a control which, on the basis of this signal and the power demand, controls the fuel charge into the cylinders of the internal-combustion engine.

According to the Bosch Manual, 22nd Edition, VDI Publishers, Düsseldorf, starting on Page 490, a lambda control can take place according to the two-point method, in the case of which an adjusting quantity changes its adjusting direction at each voltage jump which indicates a rich/lean or lean/rich change. Despite such a two-point control, aging and environmental influences (contaminations) act as a disturbing influence on the precision of measurements. For this purpose, it is known to arrange another lambda probe behind the catalyst which is subjected to the above-mentioned influences to a significantly lower extent. In the case of the principle of the two-probe control, the controlled rich or lean displacement is additively changed by a correction control loop.

In the case of engines with a low number of cylinders (up to four cylinders), a single-flow exhaust gas system, that is, an exhaust gas system with one pipe train, can be used. In the case of engines with a higher number of cylinders, the use of a two-flow exhaust gas system is more favorable in the sense of a better full-load action. However, such a completely two-flow exhaust gas system is expensive and has a poor starting behavior with respect to the pollutant reduction. As an alternative, an exhaust gas system was found to be advantageous which is constructed in a two-flow manner only in its forward portion; that is, the exhaust gases are first guided through at least two partial pipe trains divided into cylinder groups, which partial pipe trains are then combined to form a common main pipe. Such an exhaust gas system is also involved in this case.

The exhaust gas catalysts will only reach their optimal effect if they are in a certain temperature range (for example, from 400 to 800° C.). The heating of the catalyst particularly presents problems in the starting phase. In order to accelerate the heating, among other provisions, smaller precatalysts are used which are arranged in the proximity of the cylinders and can be brought particularly rapidly to their operating temperature. When different partial pipe trains or a multi-flow exhaust gas system are used, a pertaining precatalyst or starting catalyst is used for each partial pipe train. Reference is made in this context to German Patent Document DE 195 24 980 A1.

It is an object of the present invention to provide an exhaust gas system of the initially mentioned type which permits a precise adjusting of the air-fuel mixture.

This object is achieved according to preferred embodiments of the invention by providing an exhaust system of the above-noted type, wherein a lambda probe is arranged in front of each starting catalyst and, at least in one partial pipe train, an additional lambda probe is arranged behind the starting catalyst.

When using several precatalysts as well as well as lambda probes, which are in each case arranged in front of them, and another trimming or adjusting lambda probe behind a main catalyst, it presents a problem that this trimming or adjusting lambda probe detects the exhaust gases from all partial trains which are brought together in the main train. It is therefore possible that the exhaust gases may mix in such a manner that occurring lambda differences are compensated. In any case, a deviation can no longer be determined directly and can also no longer be assigned to a certain lambda probe in front of a starting catalyst or precatalyst.

For avoiding this disadvantage, on the one hand, an is additional lambda probe is provided in front of each starting catalyst and, on the other hand, at least in one partial pipe train, another lambda probe is arranged behind the starting catalyst. Depending on the exhaust gas system architecture, one or several of such system parts can be used in parallel or be interconnected.

The signals of the above-mentioned lambda probes are fed to a control which, on the basis of this information, can determine exactly those partial pipe trains or precatalysts through which a fuel-air ratio is guided which is not optimal. This permits measures for returning these unintended deviations in the individual cylinders to zero.

According to an advantageous feature of certain preferred embodiments of the invention, not all partial pipe trains have to be monitored by additional lambda probes connected behind the starting catalysts.

According to certain preferred embodiments of the invention, in order to be able to monitor all precatalysts and lambda probes connected in front of the latter, however, in the case of n partial pipe trains, n−1 additional lambda probes should be provided behind the starting catalysts.

The lambda probes in front of the starting catalysts are preferably constructed as linear lambda probes or broad band probes. The lambda probes behind the starting catalysts may be constructed as jump probes.

On the whole, by means of the lambda probes arranged behind the starting catalysts, the respective lambda probes situated in front can be trimmed or adjusted. By means of the lambda probe arranged behind the main catalyst, an overall monitoring or a monitoring of a last remaining partial train can also be achieved without any additional lambda probe. On the whole, the overall system has adjustability with respect to $\lambda=1$ or $\lambda>1$ concepts.

As a rule, the monitoring of the precatalyst function takes place by a temperature comparison between the temperatures in front of and behind the catalyst. For this purpose, two temperature sensors are required as a rule for each partial pipe train. In the case of the present invention, as an alternative, a precatalyst or starting catalyst can also be monitored by the comparison of the lambda signals in front of and behind the catalyst. In the case of a partial pipe train where no additional lambda probe is provided, a temperature probe or a temperature sensor can be arranged behind the respective precatalyst.

On the whole, the exhaust system according to the invention results in a good lambda adjustability together with a good full load behavior. In addition, a low-cost and light exhaust system can be implemented which is easy to package and has a fast starting and heat-through behavior. Also, for lean concepts ($\lambda>1$), there is the advantage of a lower consumption in comparison to a continuous two-flow system Other objects, advantages and novel features of the present invention will become apparent from the following detailed description of the invention when considered in conjunction with the accompanying drawings.

BRIEF DESCRIPTION OF THE DRAWINGS

The single drawing figure is a schematic block diagram of an embodiment of the present invention.

DETAILED DESCRIPTION OF THE DRAWINGS

In the present case, a six-cylinder engine 10 is schematically illustrated, in the case of which three cylinders respectively (specifically the cylinders of one row of cylinders) are guided into a partial exhaust pipe train 12, 14. In the partial pipe trains 12, 14, precatalysts or starting catalysts VK1, VK2 are in each case arranged in the proximity of the cylinders. Behind the precatalysts VK1, VK2, the partial pipe trains 12, 14 are brought together in a main pipe 20 into which a main catalyst HK is inserted.

When the engine 10 is started, the precatalysts VK1 and VK2 can rapidly be brought to the temperature values required for a good exhaust gas purification. After a certain starting phase, the main catalyst will then take over the largest portion of the purification of the exhaust gases flowing through it.

In front of the precatalysts VK1 and VK2, linear lambda probes for monitoring the fuel-air ratio are arranged in the corresponding partial pipe trains 12 and 14. The linear lambda probes 26 and 28 emit a signal to schematically shown electronic control system ECS and which at least on the basis of these signals and of the power demand, controls the charging of fuel into the respective cylinders by way of schematically depicted control lines C.

In order to evaluate the effects of the aging and of the environmental influences on the lambda probes 26 and 28 and carry out a corresponding trimming or adjusting in the control, on the one hand, a lambda jump probe 24 is arranged behind the main catalyst HK in the main pipe 20. This probe 24 is exposed to a much lower extent to the environmental influences. Since the lambda probe 24 is arranged in the main pipe, all exhaust gases coming from the partial pipe trains 12 and 14 flow through it, so that no detailed breakdown of deviations is possible for the individual partial pipe trains. For this reason, an additional lambda jump probe 30 is arranged in the present case in the partial pipe train 12 behind the precatalyst VK1 which emits a voltage signal also to the electronic control system ECS. On the basis of the signals of the lambda jump probes 30 and 24, the control can evaluate faulty measurements in the linear lambda probes 26 and 28 and also assign them precisely to a certain probe. Thus, by means of this arrangement, a precise adjustment of the fuel-air composition can be carried out to the required lambda value also in each individual partial pipe train.

In addition, a temperature sensor 32 (broken line) is provided in the partial pipe train 14 behind the precatalyst VK2, by means of which temperature sensor 32 the function of the precatalyst VK2 can be monitored. For this purpose, a temperature sensor 33 should also be arranged in front of the precatalyst VK2. When a suitable temperature model is used, such an additional temperature probe may not be necessary.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust system of a multi-cylinder internal-combustion engine consisting of at least one system part in which the internal-combustion engine exhaust gases or portions thereof are first guided through at least two partial pipe trains apportioned to cylinder groups, one starting catalyst respectively being inserted in each of the partial pipe trains, said partial pipe trains combining to form a joint main pipe in which a main catalyst is inserted, a lambda probe being arranged in front of each of the respective starting catalysts and a lambda probe being arranged behind the main catalyst, wherein, in the case of n partial pipe trains, only n−1 additional lambda probes are provided upstream in the partial pipe trains of the main catalyst and upstream of the joint main pipe, wherein means are provided for measuring an air/fuel ratio and generating a first air/fuel ratio signal using a first lambda probe disposed upstream of a first starting catalyst, in a first one of said partial pipe trains, wherein means are provided for measuring an air/fuel ratio and generating a second air/fuel ratio signal using a second lambda probe disposed upstream of a second starting catalyst in a second one of said partial pipe trains, wherein means are provided for measuring an air/fuel ratio and generating a third air/fuel ratio signal using a third lambda probe disposed in said first one of said partial pipe trains downstream of the first lambda probe, and wherein means are provided for controlling operation of said engine as a function of said first, second and third air/fuel ratio signals to thereby minimize pollutants in engine exhaust gases flowing through the partial pipe trains and the joint main pipe.

2. The exhaust system according to claim 1, wherein the lambda probes in front of the starting catalysts are constructed as linear lambda probes or broad band probes.

3. The exhaust system according to claim 2, wherein a temperature probe or a temperature sensor is provided in one partial pipe train behind a starting catalyst.

4. The exhaust system according to claim 1, wherein the at least one lambda probe behind the starting catalyst is constructed as a jump probe.

5. The exhaust system according to claim 4, wherein a temperature probe or a temperature sensor is provided in one partial pipe train behind a starting catalyst.

6. The exhaust system according to claim 1, wherein a temperature probe or a temperature sensor is provided in one partial pipe train behind a starting catalyst.

7. A method of operating a multi-cylinder internal-combustion engine consisting of at least one system part in which the internal-combustion engine exhaust gases or portions thereof are first guided through at least two partial pipe trains apportioned to cylinder groups, one starting catalyst respectively being inserted in each of the partial pipe trains, said partial pipe trains combining to form a joint main pipe in which a main catalyst is inserted, a lambda probe being arranged in front of each of the respective starting catalysts and a lambda probe being arranged behind the main catalyst, wherein, in the case of n partial pipe trains, only n−1 additional lambda probes are provided upstream in the partial pipe trains of the main catalyst and upstream of the joint main pipe, said method comprising:

measuring an air/fuel ratio and generating a first air/fuel ratio signal using a first lambda probe disposed upstream of a first starting catalyst, in a first one of said partial pipe trains, measuring an air/fuel ratio and generating a second air/fuel ratio signal using a second lambda probe disposed upstream of a second starting catalyst in a second one of said partial pipe trains, measuring an air/fuel ratio and generating a third air/fuel ratio signal using a third lambda probe disposed in said first one of said partial pipe trains downstream of the first lambda probe, and controlling operation of said engine as a function of said first, second and third air/fuel ratio signals to thereby minimize pollutants in engine exhaust gases flowing through the partial pipe trains and the joint main pipe.

8. The method according to claim 7, wherein the first and second lambda probes are constructed as broad band probes.

9. The method according to claim 8, wherein the third lambda probe is a jump probe.

10. The method according to claim 8, comprising measuring exhaust gas temperature and generating a first exhaust gas temperature signal using a first temperature sensor disposed in one of said partial pipe trains, and using said first exhaust gas temperature signal to further control operation of said engine.

11. The method according to claim 7, wherein the third lambda probe is a jump probe.

12. The method according to claim 7, comprising measuring exhaust gas temperature and generating a first exhaust gas temperature signal using a first temperature sensor disposed in one of said partial pipe trains, and using said first exhaust gas temperature signal to further control operation of said engine.

13. The method according to claim 12, wherein said first temperature sensor is disposed in said second partial pipe train downstream of the second starting catalyst.

14. The method according to claim 12, comprising generating a second exhaust gas temperature signal using a second exhaust gas temperature sensor disposed upstream of said second catalyst in said second partial pipe train, and using said second exhaust gas temperature signal to further control operation of said engine.

* * * * *